US005904830A

United States Patent [19]

Yamao et al.

[11] Patent Number: 5,904,830

[45] Date of Patent: May 18, 1999

[54] PROCESS FOR FINISHING STEELWIRE

[75] Inventors: Norihito Yamao; Teruyuki Murai, both of Hyogo, Japan

[73] Assignee: Sumitomo Electric Industries, Ltd., Osaka, Japan

[21] Appl. No.: 08/483,301

[22] Filed: Jun. 7, 1995

Related U.S. Application Data

[62] Division of application No. 08/068,193, May 28, 1993, abandoned.

[30] Foreign Application Priority Data

Feb. 17, 1993 [JP] Japan ..... 5-50583
Feb. 17, 1993 [JP] Japan ..... 5-53036

[51] Int. Cl.[6] ..... C25F 3/24
[52] U.S. Cl. ..... 205/640; 216/100
[58] Field of Search ..... 205/640; 216/100

[56] References Cited

U.S. PATENT DOCUMENTS

| | | | |
|---|---|---|---|
| 2,725,352 | 11/1955 | Strobel | 204/129.1 |
| 2,850,448 | 9/1958 | Stricker | 204/126.55 X |
| 3,457,107 | 7/1969 | Mickelson et al. | 216/100 X |
| 3,816,273 | 6/1974 | Snyder | 216/100 X |
| 4,233,089 | 11/1980 | Lanner | 148/36 |
| 4,909,866 | 3/1990 | Abe et al. | 148/333 |
| 5,066,370 | 11/1991 | Andreshak et al. | 204/129.1 |

FOREIGN PATENT DOCUMENTS

| | | |
|---|---|---|
| 0232061 | 8/1987 | European Pat. Off. . |
| 0265273 | 4/1988 | European Pat. Off. . |
| 0400564 | 12/1990 | European Pat. Off. . |
| 63-052729 | 5/1988 | Japan . |
| 4247824 | 3/1990 | Japan . |
| 5023772 | 2/1993 | Japan . |

OTHER PUBLICATIONS

Patent Abstracts of Japan, vol. 13, No. 61 (C–567)(3409) Feb. 10, 1989.

Patent Abstracts of Japan, vol. 12, No. 165 (C–496)(3012) May 18, 1988.

*Primary Examiner*—Donald R. Valentine
*Attorney, Agent, or Firm*—Sughrue, Mion, Zinn, Macpeak & Seas

[57] ABSTRACT

A spring steel wire that has a tensile strength of at least 2,000 $N/mm^2$ and a surface roughness of not more than 5 $\mu$m in terms of Rz, and a spring steel wire that consists essentially of from 0.5 to 0.8% by weight of C, from 1.2 to 2.5% by weight of Si, from 0.4 to 0.8% by weight of Mn, from 0.7 to 1.0% by weight of Cr, from 0.005 to 0.030% by weight of N and at least two elements selected from the group consisting of from 0.1 to 0.6% by weight of V, from 0.05 to 0.50% by weight of Mo and from 0.05 to 0.50% by weight of W, with the balance being Fe and incidental impurities containing not more than 0.005% by weight of Al and not more than 0.005% by weight of Ti, said wire having a surface roughness of not more than 5 $\mu$m in terms of Rz, as well as production processes therefor.

2 Claims, No Drawings

PROCESS FOR FINISHING STEELWIRE

This is a divisional of application Ser. No. 08/068,193 filed May 28, 1993, now abandoned.

FIELD OF THE INVENTION

The present invention relates to spring steel wires for use in applications where fatigue-resisting property is required such as valve springs on automobile engines.

BACKGROUND OF THE INVENTION

Conventional techniques on springs having high fatigue-resisting characteristics have been described, e.g., in JP-A-4-367346 in which the surface of steel wires is electropolished or chemically polished so as to remove micro-defects on it, thereby improving the fatigue resistance or the wires. (The term "JP-A" as used herein means an unexamined published Japanese patent application.) This approach which involves electropolishing or chemically polishing the surface of spring steel wires is effective to a certain extent in improving the fatigue limit since the surface of the wires is made smooth. However, further improvements in the fatigue limit have been impossible on account of the low materials strength.

The present inventors have made an attempt to improve the fatigue resistance of a wire in which some kinds of elements for enhancing the strength of materials are added. However, the attempt at achieving high fatigue resistance by enhancing the materials strength has had the problem in that the increase in materials strength is accompanied by increasing defect sensitivity and that a micro-defect developing on the surface can propagate to cause flexural failure due to fatigue. Hence, it has been impossible to achieve improvement in the fatigue limit beyond a certain value.

The present invention has been accomplished under these circumstances.

SUMMARY OF THE INVENTION

An object of the present invention is to provide a spring steel wire that has good enough fatigue-resisting property to perform satisfactorily on automobile engines even when their output power is increased.

Another object of the present invention is to provide a process for producing such a spring steel wire.

Other objects and effects of the present invention will be apparent from the following description.

The present invention relates to a spring steel wire that has a tensile strength of at least 2,000 N/mm$^2$ and a surface roughness of not more than 5 $\mu$m in terms of Rz (the ten-point average roughness defined by JIS B0601).

The present invention also relates to a spring steel wire that consists essentially of from 0.5 to 0.8% by weight of C, from 1.2 to 2.5% by weight of Si, from 0.4 to 0.8% by weight of Mn, from 0.7 to 1.0% by weight of Cr, from 0.005 to 0.030% by weight of N and at least two elements selected from the group consisting of from 0.1 to 0.6% by weight of V, from 0.05 to 0.50% by weight of Mo and from 0.05 to 0.50% by weight of W, with the balance being Fe and incidental impurities containing not more than 0.005% by weight of Al and not more than 0.005% by weight of Ti, said wire having a surface roughness of not more than 5 $\mu$m in terms of Rz.

In a preferred embodiment, the above spring steel wires retain a tensile strength of at least 1,800 N/mm$^2$, more preferably from 1,800 to 2,500 N/mm$^2$, and a surface roughness of not more than 5 $\mu$m even after it has been annealed at 500° C. for 2 hours.

To produce these spring steel wires, the surface of steel wires having the composition and/or strength specified above is electropolished or chemically polished to a surface roughness of not more than 5 $\mu$m in terms of Rz.

DETAILED DESCRIPTION OF THE INVENTION

In accordance with the present invention, the chemical composition of the starting material is not particularly limited as long as it is conditioned in such a way to provide a tensile strength of at least 2,000 N/mm$^2$, and preferably from 2,000 to 2,700 N/mm$^2$. The tensile strength is specified to be at least 2,000 N/mm$^2$ because below that value, satisfactory fatigue strength cannot be attained. The method for attaining the tensile strength of at least 2,000 N/mm$^2$ is not particularly limited, and it can be attained, for example, by adjusting the composition of the material to the above-mentioned range, or by lowering the tempering temperature.

Alternatively, the chemical composition of the starting material used in the present invention is adjusted to the above-mentioned ranges, while the tensile strength thereof is not particularly limited.

The starting material is then electropolished or chemically polished to remove any significant surface defects so as to attain a surface roughness of not more than 5 $\mu$m, preferably from 2 to 5 $\mu$m, in terms of Rz, thereby improving the fatigue resistance of the material. The conditions of electropolishing and chemical polishing are not particularly limited as long as the surface roughness of not more than 5 $\mu$m in terms of Rz can be realized. For example, the electro-polishing can be conducted in a solution composed of phosphoric acid, sulfuric acid, and water (volume ratio: 7/2/1) at a current density of 250 A/dm$^2$ for 50 seconds, and the chemical polishing can be conducted in a solution aqueous hydrogen peroxide and hydrofluoric acid (volume ratio: 97/3) for 30 seconds.

The surface roughness is specified to be not more than 5 $\mu$m in terms of Rz because above that value, not all significant surface defects can be removed and a micro-defect can propagate until it becomes deleterious to the development of satisfactory fatigue resistance.

The composition of the spring steel wire of the present invention is described below in detail.

The content of carbon (C) is from 0.5 to 0.8% by weight, and preferably from 0.6 to 0.8% by weight. Carbon is an element essential for enhancing the strength of steel wires. If the carbon content is less than 0.5% by weight, no satisfactory strength can be attained. If the carbon content exceeds 0.8% by weight, the toughness of the steel wire is lowered and, furthermore, its defect sensitivity is increased as to lower its reliability.

The content of silicon (Si) is from 1.2 to 2.5% by weight, and preferably from 1.2 to 2.0% by weight. Silicon is an element that is effective in improving the strength and failure resistance of ferrites. If the silicon content is less than 1.2% by weight, it is not effective satisfactorily. If the silicon content exceeds 2.5% by weight, the cold workability of the steel is lowered and, at the same time, accelerated decarburization can occur during hot working or other heat treatments.

The content of manganese (Mn) is from 0.4 to 0.8% by weight, and preferably from 0.5 to 0.8% by weight. Manganese not only improves the quenchability of steels but also fixes sulfur (S) in the steels so as to render it harmless. If the manganese content is less than 0.4% by weight, these effects are not attained. If the manganese content exceeds 0.8% by weight, the toughness of the steel is lowered.

The content of chromium (Cr) is from 0.7 to 1.0% by weight. Similar to the case of manganese, chromium improves the quenchability of steels. Furthermore, chromium is an element that is effective in imparting toughness by a patenting operation subsequent to hot rolling and enhancing the resistance to temper softening after quenching, so as to increase the strength of the steel. If the chromium content is less than 0.7% by weight, these effects are not achievable. If the Cr content exceeds 1.0% by weight, carbides will not be fully dissolved as a solid solution, leading to lower strength of the steel. Furthermore, the quenchability of the steel becomes excessive to lower its toughness.

The content of nitrogen (N) is from 0.005 to 0.030% by weight. Nitrogen binds with aluminum and contributes to the decreasing of grain size; at the same time, nitrogen works as an element for causing solid-solution hardening in ferrites. If the nitrogen content is less than 0.005% by weight, it is not effective satisfactorily. If the nitrogen content exceeds 0.030% by weight, the toughness of the steel will decrease.

TABLE 1

| | Component (% by weight) | | | | | | | | | | |
|---|---|---|---|---|---|---|---|---|---|---|---|
| Sample | C | Si | Mn | Cr | V | Mo | W | Al | Ti | N | Fe |
| A-1 | 0.67 | 1.46 | 0.61 | 0.78 | 0.23 | 0.21 | 0.18 | 0.004 | 0.002 | 0.007 | balance |
| A-2 | 0.67 | 1.47 | 0.62 | 0.75 | 0.22 | 0.39 | — | 0.003 | 0.003 | 0.010 | balance |
| B | 0.65 | 1.38 | 0.68 | 0.69 | 0.18 | — | — | 0.004 | 0.004 | 0.010 | balance |
| C | 0.56 | 1.38 | 0.72 | 0.70 | — | — | — | 0.002 | 0.002 | 0.018 | balance |

The content of vanadium (V) is from 0.1 to 0.6% by weight, and preferably from 0.1 to 0.5% by weight. Vanadium forms carbides in the steel and decreases austenite grain size so as to improve the endurance of the steel. If the vanadium content is less than 0.1% by weight, these effects are not achieved. If the vanadium content exceeds 0.6% by weight, carbides tend to become less soluble as a solid solution, thus causing adverse effects on subsequent heat treatments.

The content of molybdenum (Mo) is from 0.05 to 0.50% by weight, and preferably from 0.1 to 0.4% by weight. Molybdenum is an element that is effective in improving the failure resistance of springs. In addition, it enhances the resistance to temper softening so as to impart higher endurance. If the molybdenum content is less than 0.05 % by weight, it is not effective satisfactorily. If the molybdenum content exceeds 0.50% by weight, the drawability of the steel into wires is impaired.

The content of tungsten (W) is from 0.05 to 0.50% by weight, and preferably from 0.05 to 0.20% by weight. Tungsten binds with carbon to form carbides, thus decreasing the grain size. At the same time, it enhances the resistance to temper softening so as to impart higher endurance. If the tungsten content is less than 0.05% by weight, it is not effective satisfactorily. On the other hand, the effectiveness of tungsten is in no way improved even if its content exceeds 0.50% by weight.

The contents of aluminum (Al) and titanium (Ti) each is not more then 0.005% by weight. These elements produce $Al_2O_3$ and TiO which both are high-melting point inclusions. These inclusions are hard and will cause marked decrease in the fatigue resistance of steel wires if they are present right under the surface of the wires. To avoid these problems, the content of each of Al and Ti is not more than 0.005% by weight while they are incidental impurities. This requirement can be met by selecting starting materials that have low contents of aluminum and titanium.

The following examples are provided for the purpose of further illustrating the present invention but are in no way to be taken as limiting.

EXAMPLES

Samples having the compositions shown in Table 1 were provided and melted in an induction furnace. The melts were forged and hot rolled into wires having a diameter of 6.5 mm. Sample C was a comparative example (JIS SWOSC-V). Following a heat treatment, the wires were shaved and cold drawn to a diameter of 3.8 mm. By subsequent quenching and tempering, steel wires having the mechanical characteristics shown in Table 2 were produced.

Another group of the same samples were subjected to annealing at 500° C. for 2 hours, which was equivalent to nitriding; the thus treated wire samples were also measured for their mechanical characteristics. The results are also shown in Table 2.

TABLE 2

| | After quench and temper | | After annealing (500° C., 2 h) | |
|---|---|---|---|---|
| Sample | Tensile strength ($N/mm^2$) | Reduction of area (%) | Tensile strength ($N/mm^2$) | Reduction of area (%) |
| A-1 | 2,142 | 46 | 1,824 | 50 |
| A-2 | 2,111 | 42 | 1,883 | 48 |
| B | 2,080 | 44 | 1,657 | 46 |
| C | 1,892 | 51 | 1,510 | 52 |

Another group of samples that were treated up to the stage of quenching and tempering (but not to the annealing) were electropolished and measured for Rz (ten-point average roughness under JIS B0601). Rz measurement was also conducted before the electropolishing. The results are shown in Table 3.

TABLE 3

| | Surface roughness Rz | |
|---|---|---|
| Sample | Before electropolish ($\mu$m) | After electropolish ($\mu$m) |
| A-1 | 9.0 | 4.0 |
| A-2 | 9.7 | 4.5 |
| B | 8.7 | 4.2 |
| C | 9.6 | 3.8 |

The steel wires thus prepared were shaped into springs according to the specifications shown in Table 4 and subjected to strain-relief annealing at 420° C. for 30 min, followed by being nitrided at 500° C. for 2 hours. Subsequently, the wires were subjected to shot peening, first by using cut wires (diameter: 0.7 mm) for 30 min, then using steel balls (diameter: 0.3 mm) for 30 min. Thereafter, the wires were subjected to low-temperature (200° C.) annealing for 20 min. The thus produced coil springs were subjected to a fatigue test on a spring fatigue tester. The testing conditions were as follows: the average stress of 686 MPa was applied repeatedly through a total of $5\times10^7$ cycles with the stress amplitude being varied and the amplitude of stress that could be applied without causing flexural failure was designated as the "fatigue limit". The test results are shown in Table 5.

TABLE 4

| | |
|---|---|
| Wire diameter (mm) | 3.8 |
| Average coil diameter (mm) | 24.5 |
| Free length (mm) | 64.0 |
| Effective number of turns | 4.5 |
| Total number of turns | 6.5 |

TABLE 5

| Sample | Electropolish | Fatigue limit ($5 \times 10^7$ cycles, $\tau m$ = 686 Mpa) (MPa) |
|---|---|---|
| A-1 | yes | 608 |
| A-1 | no | 520 |
| A-2 | yes | 598 |
| A-2 | no | 520 |
| B | yes | 539 |
| B | no | 470 |
| C | yes | 466 |
| C | no | 417 |

As Table 5 shows, the samples of the present invention (electropolished samples of A-1, A-2 and B) were found to have excellent fatigue-resisting property as compared with the comparative samples (C and non-electropolished samples of A-1, A-2 and B). In particular, the electropolished samples of A-1 and A-2 which were limited in composition and which had tensile strengths of more than 1,800 N/mm$^2$ after annealing at 500° C. for 2 hours were found to have an excellent fatigue-resisting quality.

As described in the foregoing, springs having good fatigue characteristics can be produced by using the steel wires of the present invention which are limited in terms of tensile strength and surface roughness. In particular, the springs produced from the steel wires that are limited in terms of either their composition ranges or the tensile strength and surface roughness after prolonged annealing at 500° C. exhibit excellent fatigue characteristics. Therefore, the steel wires of the invention are effective, e.g., in valve springs and other components of automobile engines on which increasing improvements have been made in recent years.

While the invention has been described in detail and with reference to specific embodiments thereof, it will be apparent to one skilled in the art that various changes and modifications can be made therein without departing from the spirit and scope thereof.

What is claimed is:

1. A process for finishing a spring steel wire comprising the step of electropolishing or chemically polishing the surface of a steel wire to a surface roughness of not more than 5 $\mu$m in terms of Rz, said wire having a tensile strength of at least 2,000 N/mm$^2$.

2. A process for finishing a spring steel wire comprising the step of electropolishing or chemically polishing the surface of a steel wire to a surface roughness of not more than 5 $\mu$m in terms of Rz, said wire consisting essentially of from 0.5 to 0.8% by weight of C, from 1.2 to 2.5% by weight of Si, from 0.4 to 0.8% by weight of Mn, from 0.7 to 1.0% by weight of Cr, from 0.005 to 0.030% by weight of N and at least two elements selected from the group consisting of from 0.1 to 0.6% by weight of V, from 0.05 to 0.50% by weight of Mo and from 0.05 to 0.50% by weight of W, with the balance being Fe and incidental impurities containing not more than 0.005% by weight of Al and not more than 0.005% by weight of Ti.

* * * * *